United States Patent [19]

Ponvianne et al.

[11] Patent Number: 4,967,813

[45] Date of Patent: Nov. 6, 1990

[54] BOTTLE FILLING MACHINE AND FILLING HEAD THEREFOR

[75] Inventors: Gabriel Ponvianne, Bellerive; Jean-Pierre Bosman, Eschentzwiller, both of France

[73] Assignee: Mapco, Illfurth, France

[21] Appl. No.: 312,841

[22] Filed: Feb. 21, 1989

Related U.S. Application Data

[62] Division of Ser. No. 116,809, Nov. 5, 1987, abandoned.

[30] Foreign Application Priority Data

Nov. 5, 1986 [FR] France ..... 86 15403

[51] Int. Cl.[5] ..... B67C 3/06

[52] U.S. Cl. ..... 141/128; 141/46; 141/83; 141/95; 141/91; 251/61.1; 137/513.3

[58] Field of Search ..... 141/128, 46, 83, 95, 141/96, 192, 198, 89–91; 251/61.1; 137/414, 513.3, 392

[56] References Cited

U.S. PATENT DOCUMENTS

| | | | |
|---|---|---|---|
| 3,038,488 | 6/1962 | Welch et al. | 251/61.1 X |
| 3,150,697 | 9/1964 | Risser | 141/217 |
| 3,862,708 | 1/1975 | Waxlax | 141/128 X |
| 3,893,493 | 7/1975 | Forrest et al. | 141/95 X |
| 3,914,961 | 11/1975 | Dilger | 141/46 |
| 4,522,237 | 6/1985 | Endo et al. | 141/95 |
| 4,537,387 | 8/1985 | Danby et al. | 251/61.1 X |
| 4,787,427 | 11/1988 | Bacroix et al. | 141/46 X |
| 4,787,428 | 11/1988 | Bacroix et al. | 141/46 X |
| 4,848,722 | 7/1989 | Webster | 251/61.1 |

FOREIGN PATENT DOCUMENTS

| | | |
|---|---|---|
| 0235065 | 9/1987 | European Pat. Off. . |
| 1129783 | 5/1962 | Fed. Rep. of Germany . |
| 2095562 | 2/1972 | France . |
| 2074144 | 10/1981 | United Kingdom . |

*Primary Examiner*—Ernest G. Cusick

*Attorney, Agent, or Firm*—Pollock, Vande Sande & Priddy

[57] ABSTRACT

A filling head for a machine for automatic filling of bottles to a constant level, particularly in free air, and a filling machine equipped with such filling heads. The filling head has a circulation chamber into which the filling liquid enters via a feed orifice and from which the filling liquid leaves via a lower outlet orifice which is extended by a discharge tube for penetrating inside a neck of a bottle during filling. A membrane with a projection opens or closes the outlet orifice in response to control signals emitted by a detector of the filling level arranged on a zone of the discharge tube situated inside the bottle during filling.

20 Claims, 5 Drawing Sheets

10
12
14
16
20
22
-18-
-40-
44
46
48
50
54
56
66
68
69
71
79
132
134
136
138
139
141
142
23
24
25
26
28
30
"D"
167
169
170
180
181
182
183
184
185
186

10
12
14
16
20
22
-18-
40
44
46
48
50
54
56
66
68
69
71
79
132
134
136
138
139
142
23
24
25
26
28
30
"d"
167
169
170
180
181
182
183
184
185
186

BOTTLE FILLING MACHINE AND FILLING HEAD THEREFOR

This is a division of application Ser. No. 116,809, filed Nov. 5, 1987, abandoned.

FIELD OF THE INVENTION

The present invention relates to a filling head for a machine for automatic filling of bottles, particularly in free air, comprising a body delimiting a circulation chamber into which a filling liquid enters via a feed orifice and from which the filling liquid leaves via an outlet orifice which is situated at a lower part of the circulation chamber and is extended by a discharge tube able to penetrate inside a neck of a bottle during filling, as well as a closure element of a control valve, which opens or closes one of the two said orifices in response to control signals emitted by means for detection of the filling level arranged on a zone of the discharge tube situated inside the bottle during filling.

BACKGROUND OF THE INVENTION

Such a filling head is described in French Patent No. 2 095 562, which discloses a closure element for a control valve, an electrovalve acting in the region of the feed orifice for the circulation chamber, and comprising a mechanical obturator in the form of a piston sliding in the body of the filling head, either towards a closure position of the feed orifice under the action of an electro-magnet, or towards an open position of this feed orifice under the action of a return spring.

Because of the control of the stopping of the passage of filling liquid towards the bottle by detection of a liquid level in the latter, this known filling head ought to permit filling of bottles to a rigorously constant level, determined by the level of the detection means for a predetermined level of each bottle in the course of filling.

Nevertheless, this known filling head has a certain imprecision in the final effective filling level of each bottle, because of the positioning of the closure element of the controlled valve in the region of the feed orifice of the circulation chamber, and because of the structure of this closure element of the control valve. The positioning of the closure element of the control valve disclosed in the French Patent No. 2 095 562 results in the fact that, when this element reaches its position of closure of the feed orifice of the circulation chamber after the filling liquid in the bottle has reached the level of the detection means and these means have emitted a corresponding control signal, found between this closure element of the controlled valve and a zone of the lower end of the discharge tube extending inside the bottle, and this volume can be more or less discharged into the bottle after the instant at which the closure element of the controlled valve has reached its closed position. As a result, this instant does not necessarily coincide with the actual instant of stopping of discharge of the filling liquid into the inside of the bottle, and the level finally reached in this latter by the filling liquid can more or less pass, in an uncontrollable manner, the level of the detection means; this results in a first factor for imprecision of the level effectively reached in the bottle, by the filling liquid, at the end of filling. The structure chosen for the closure element of the controlled valve makes it necessary to provide sealing means with respect to the outside, both in the region of the connection between the obturator and the electromagnet, and in the region of the connection between the obturator and the return spring, which necessarily leads to a more or less controllable retardation of the movement of the obturator towards its position of closure of the feed orifice for the circulation chamber from the instant where the level of the liquid in the bottle being filled has reached the detection means, and where these detection means have emitted a corresponding control signal. From this, the arrival of the obturator in the closure position of the feed orifice for the circulation chamber is retarded, in an undetermined manner, with respect to the effective arrival of the level of the liquid in the bottle at the level of detection means.

Further, because of its structural complexity, particularly in the region of the closure element of the controlled valve, the filling head recommended in French Patent No. 2 095 562 is not hygienic, because it has numerous recesses constituting zones for accumulation and possible development of germs and bacteria and zones which are difficult to clean by circulation of cleaning liquid, i.e., in accordance with the normal method used for cleaning machines for automatic filling of bottles.

SUMMARY OF THE INVENTION

The object of the present invention is to overcome these drawbacks by means of a filling head of the type referred to above in which the closure element of the valve is a flexible membrane which delimits a fluid-tight control chamber arranged inside the circulation chamber and comprises opposite an outlet orifice a projecting portion having an external surface adapted to co-operate with an edge of the outlet orifice in order to close the latter, the membrane being deformable between an opening conformation of the outlet orifice, in which the said external surface is separated from the edge of the outlet orifice, and a closure conformation of the outlet orifice, in which the external surface co-operates with the said edge of the outlet orifice for closing this latter in a fluid-tight manner, and the control chamber is connected to fluidic control means for deformation of the membrane from one to the other of the said conformations and inversely as a function of the control signals.

In comparison with the known filling head mentioned above, a filling head according to the invention is characterized by great simplicity of structure, remarkable particularly by the absence of any joint slowing the movements of the closure element of the controlled valve into its position closing passage of the filling liquid towards the bottle. Also the arrival of the liquid, in the bottle, at the level of the means for detecting the filling level can immediately be followed by closure of the passage of the liquid towards the bottle. As the height of the bottle with respect to the filling head can be perfectly defined by the structure of the machine, thanks to means known per se, filling of bottles to a constant level can be easily provided; the volume of filling liquid present between the closure element of the controlled valve and the interior of the discharge tube can be reduced to a minimum and it is easy either to provide arrangements causing its entire discharge into the bottle, for example in the form of a hole bored laterally in the discharge tube (in which case one takes account of this easily determinable residual quantity in positioning the means for detection of the filling level with respect to the filling level effectively desired), or to retain this residual quantity of liquid in the discharge tube, for example by means of a grille closing this latter at the bottom and retaining the liquid there by capillary action; such arrangements are known to those skilled in the art.

The great simplicity of the structure of the filling head according to the invention, and the considerable reduction of the number of joints therein because of the absence of movable parts, connected to the outside, by way of the closure element of the controlled valve also permits reduction of the risk of accumulation and development of germs and bacteria, for geometric reasons, and further permits efficacious cleaning by circulation of cleaning liquid.

Further, the filling head according to the invention easily lends itself to an embodiment permitting filling of a bottle in two successive flows, i.e., a rapid flow at the beginning of filling, followed by a slow flow at the end of filling, for obtaining with precision a predetermined level of filling.

For this purpose, the above-mentioned French patent recommends arrangement of a circuit channelling the air escaping from the bottle during filling of the latter, and the throttling in this circuit after a predetermined filling time, for reducing the subsequent flow, until the liquid in the bottle reaches the level of the detection means. This is a complex arrangement, while the escape of air in the course of filling a bottle in free air can be easily carried out in the case of a filling head according to the present invention, if the filling tube is given an external diameter less than the internal diameter of the neck of the bottle to be filled. It can be further provided, in a filling head according to the present invention, that the membrane has an intermediary conformation for partial closure of the outlet orifice, and that the fluidic control means can place the membrane in this intermediate conformation as a function of the control signals.

In a preferred embodiment of the invention, to this end, the projecting portion is elastically compressible, in that the edge of the outlet orifice and a zone of the external surface of the projecting portion (which zone co-operates with the edge when the membrane has the said closure conformation) has different forms when the membrane has the open conformation so that, when the membrane has the intermediary conformation, the external face and the edge are in localised discontinuous mutual contact and that, when the membrane has the said closure conformation, the projection is elastically compressed to establish continuous fluid-tight contact with the edge.

Thus, a single closure element of the controlled valve, i.e., the membrane, permits, during filling, the transformation from a rapid initial flow of filling liquid to a final slow flow, then the interruption of the passage of filling liquid. The transformation from rapid flow to slow flow can be caused by a delay or by a cell, but it can also be produced by a level detection from the means for detection of the level of filling which first detects the arrival at their level of a froth produced by the rapid flow filling, for causing the transformation from rapid flow to slow flow, then of the liquid as such, after reabsorption of the froth, for then interrupting the discharge of the liquid.

One embodiment of a filling head, according to the invention greatly simplifies the structure of filling machines which it equips. In particular, the absence of a channelling circuit for the air coming from the bottle, in the case of filling in free air, is only necessary to clean the circuit taken by the filling liquid, and this cleaning is easily carried out by reverse-flow, in the interests of maximum efficacy.

In consequence, the present invention also proposes a machine for filling bottles, equipped with filling heads produced in accordance with its teaching, and comprising at its lower part hollow bottle-carrying means on which the heads can be arranged in a fluid-tight manner by a relative approach movement, for cleaning operations of the machine, and comprising a single cleaning circuit comprising a pump which circulates the cleaning liquid under pressure inside the bottle-carrying means and then inside the filling heads, by reverse-flow of the filling liquid, the said flexible, deformable membranes having their open conformation.

The holding of the membranes in this conformation can be assured by the pressure of cleaning liquid which enters via the discharge tube and causes the separation of the membrane from the outlet orifice. This holding can equally be caused by the voluntary emission of appropriate control signals, during cleaning, or result from a natural tendency of the membrane to take up its open conformation.

Preferably, the filling machine according to the invention is arranged, in a manner known per se, in the form of a carousel having a plurality of filling heads spaced around a common axis of rotation. During this rotation, at a fixed station an empty bottle enters under each filling head, which bottle is then progressively filled by this filling head before being taken away in filled condition, also at a fixed station.

BRIEF DESCRIPTION OF THE DRAWINGS

The invention will be better understood by reference to the following description of several embodiments, as well as the accompanying drawings, which form an integral part of this description.

DESCRIPTION OF THE PREFERRED EMBODIMENTS

Figure 2:
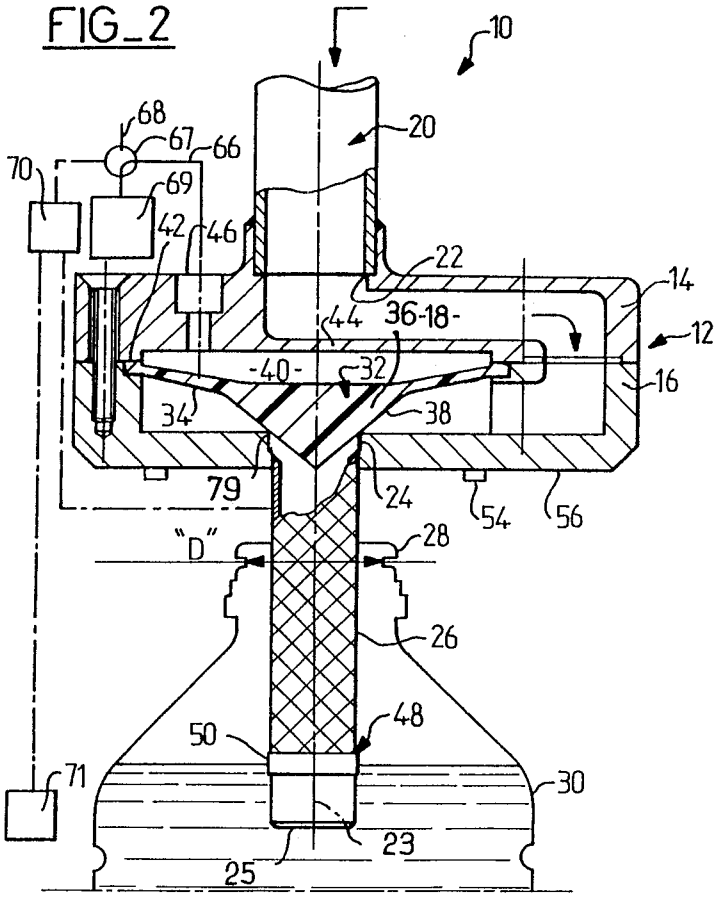
Figure 1:
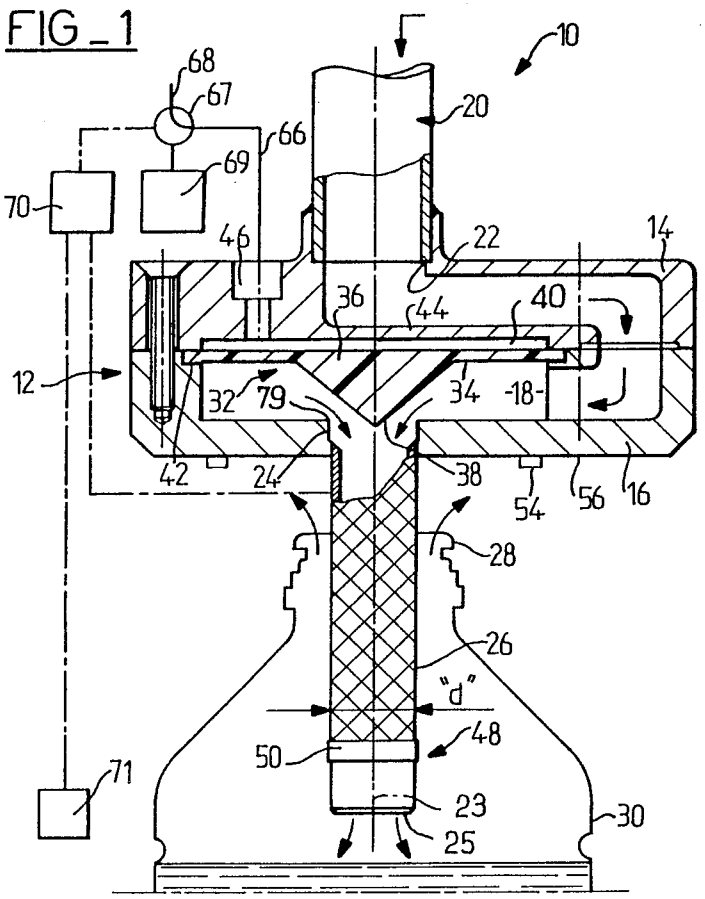
FIG. 1 is a partial cross-sectional view, cut on a vertical axis, of a first embodiment of a filling head according to the invention of which the membrane is shown in its open conformation of the outlet orifice of the filling liquid circulation chamber, during filling of a bottle in FIG. 2 is a view similar to that of FIG. 1, when the membrane has its conformation closing the outlet orifice, at the end of filling.

FIGS. 1 and 2 show a filling head 10 having a body 12 formed of upper and lower rigid shells 14 and 16, respectively.

The two shells 14 and 16 are hollow and delimit together a fluid-tight chamber 18 for circulation of filling liquid.

Figure 13:
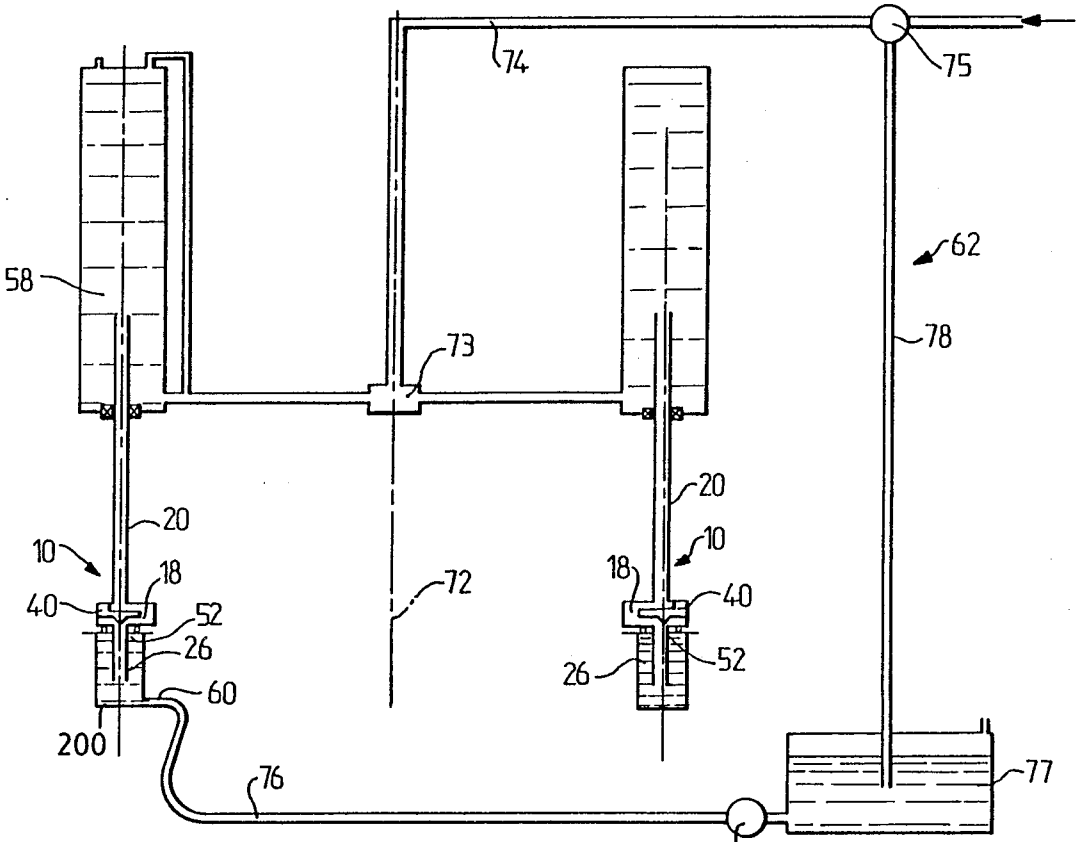
FIG. 13 is a simplified schematic view, in vertical section of a filling machine with a carousel equipped with heads according to the present invention, and more particularly of its cleaning circuit.

The body 12 is provided at its upper part with a feed tube 20 connected to a filling vat 58 (see FIG. 13) which is arranged above the body 12 and contains the liquid with which the bottles are to be filled. In a manner known per se itself, the vat 58 can be at or above atmospheric pressure.

Coming from the feed tube 20, the filling liquid enters via a feed orifice 22, formed at the upper part of the body 12, in the circulation chamber 18.

After having traversed the circulation chamber 18, the filling liquid is able to leave via an outlet orifice 24 situated at the lower part of the body 12, in fact the lowest part of the circulation chamber 18.

The outlet orifice 24 is extended vertically downwards by a rigid discharge tube 26, with a vertical axis 23, which is open downwards via a lower orifice 25 and which enters into the neck 28 of a bottle 30 when the latter occupies a predetermined filling position in which it is arranged below the body 12, without contact with the body at a predetermined relative height, and in which its neck 28 is coaxial with the discharge tube 26.

According to the invention, the head has a controlled closure element 32 which opens the outlet orifice 24 when an empty bottle 30 occupies the filling position and so long as the desired filling level has not been reached in this bottle, and closes the outlet orifice 24 when the bottle is filled to the desired constant level.

In the embodiment illustrated in FIGS. 1 and 2, the valve closure element 32 is a flexible deformable membrane 34, having the shape of a body of revolution about the axis 23 of the discharge tube 26. More precisely, the membrane has the shape of a disc which has a central portion 36 projecting downwards, presenting a conical exterior surface 38, adapted to co-operate with a circular horizontal edge 79 of the outlet orifice 24 in order to fluid-tightly close the latter, as can be seen in FIG. 2. Nevertheless, by elasticity or the action of a return spring (not shown), the flexible membrane 34, which may be made of synthetic or natural rubber, tends naturally to have a conformation in which its surface 38 is separated from the circular edge 79 of the outlet orifice 24 for opening this latter, as FIG. 1 shows.

The flexible, fluid-tight membrane 34 partially delimits a fluid-tight control chamber 40 arranged inside the circulation chamber 18. To this end, the circular edge 42 of the membrane is captured in a fluid-tight manner between the two shells 14 and 16, upon assembly of the two latter. The control chamber 40 is also delimited in a fluid-tight manner by an internal rigid partition 44, formed in the upper shell 14 and extending horizontally and substantially in the plane of the joint between shells 14 and 16, under but at a distance from the orifice 22 in order not to impede the passage of liquid through this orifice.

The control chamber 40 which is fluid-tight to the filling liquid is connected via a connection orifice 46 to a duct 66 provided with a distribution valve 67 permitting the connection of the chamber 40 either to a vent 68, open to atmosphere, or to a source of fluid under pressure 69, for example air under pressure, with respect to which the chamber 40 is also fluid-tight.

In order to ensure control of the closure element 32, by elastic deformation of the membrane 34, the admission of fluid under pressure inside the control chamber 40 is controlled as a function of control signals, via an electronic control circuit 70 determining the position of the valve 67.

According to the invention, the control signals for closure of the outlet orifice 24 by the closure element of the valve 32 are emitted, by means 48 for detection of the level of filling, an embodiment of which will now be described.

According to this example, the discharge tube 26 is made of an electrically conductive material, for example stainless steel, and is covered with an external layer of insulating material in which is inserted a metallic probe at the level 50 arranged on the external zone of the wall of the discharge tube 26 which is situated at the interior of the bottle 30 when this occupies the filling position, for example in the form of a coaxial tubular element of the discharge tube 26.

The discharge tube 26 is connected to the body of the filling machine and the probe 50 to an electronic circuit 70, ensuring level detection by measurement of resistivity in a manner easily conceivable by those skilled in the art.

If valve 67 initially occupies the position illustrated in FIG. 1, opening the chamber 40 to atmosphere via the vent 68 isolating the chamber 40 from the source of fluid under pressure 69, this signifies that the membrane 34 has its conformation for opening the orifice 24, the filling liquid being discharged into the bottle 30 in its filling position. When the filling liquid reaches the level probe 50, an alternating current of low intensity passes between the tube and the probe, through the filling liquid. This current is amplified and causes the commutation of a relay (not shown) of the circuit 70 which controls the commutation of the valve 67 towards its position isolating the chamber 40 with respect to the vent 68 and placing in communication the chamber 40 and the source of fluid under pressure 69, thus causing the admission of fluid under pressure inside the fluid-tight chamber 40 and the transformation formation of the membrane 34 to its conformation for closure of the orifice 24, as illustrated in FIG. 2.

In order to permit free escape of air from the bottle 30 during its filling, the discharge tube has an external diameter d less than the internal diameter D of the neck 28 of the bottle.

In order to control the opening of the closure element 32 by opening of the control chamber 40 to the vent 68 via the valve 67, the same electronic control circuit 70 is used as in the closure, and the control circuit connected for this purpose to means 71 for the detection of the presence of a bottle 30 in the filling position. The absence of any bottle 30 from the filling position is translated by the emission of a control signal which, processed by the circuit 70, ensures the holding of the chamber 40 in communication with the source of fluid under pressure 69, i.e., a closure of the orifice 24. The of a bottle 30 in the filling position causes the emission by the means 71 of a signal which permits the opening of the orifice 24 by commutation of the valve 67, but this opening is only effective if the level probe 50 emits a control signal showing that the bottle 30 is empty.

The embodiment of the circuit 70 is of a type conventional for those skilled in the art, as regards the choice of presence detection means 71 which may be mechanical, optical or of any other kind. The same is true of the level detection means, which can be of any appropriate type, and for example make use of optical or ultrasonic detection.

Further, according to a non-illustrated variant, the membrane 34, as well as being identical to that which has been described can have, via its own elasticity or under the action of an auxiliary spring its conformation for closure of the orifice 24, illustrated in FIG. 2. Those skilled in the art will easily understand that, in the installation which has been described with reference to FIGS. 1 and 2, it would be sufficient to replace the source of fluid under pressure 69 by vacuum means and to reverse the positions of the valve 67 corresponding respectively to the emission of control signals resulting from the detection of an empty bottle in the filling position under the filling head, by the means 71, and to the emission of control signals resulting from the detection of the level of filling liquid in this bottle reaching the pre-determined desired level, by the means 48. Detection of an empty bottle 30 in the filling position then causes the passage of the valve 67 to a position for connection between the control chamber 40 and the evacuation means, which causes the transformation of the membrane 34 to the open conformation illustrated in FIG. 1. The arrival of the level of the filling liquid in the bottle 30 at the level probe 50 itself causes the passage of the valve 67 to its position for opening the control chamber 40 to atmosphere via the vent 68, which permits the return of the membrane 34 to its conformation for closure of the orifice 24, as illustrated in FIG. 2.

This variant is advantageous because the membrane can be returned without difficulty to its closure conformation, for stopping discharge of the filling liquid, in the case of breakdown by simple commutation, possibly manual, of the valve 67 into its position for opening the chamber 40 to atmosphere via the vent 68.

The first embodiment of the invention which has been described, as well as its variant, permits only on/-off functioning, i.e., with discharge of the filling liquid at a determined flow rate when the membrane has its conformation for opening of the outlet orifice from the circulation chamber, and complete stoppage of the flow when the membrane has its conformation for closure of this orifice.

FIGS. 3 to 11 illustrate other embodiments, permitting a flow intermediate open conformation of the membrane and the zero flow corresponding to its closed conformation, this intermediate flow corresponding to an intermediate conformation of the membrane obtained with the other conformations by fluidic control.

More precisely FIGS. 3 to 7 illustrate a second embodiment of the invention, in which is found identically and under the same references the assembly of elements of the filling head illustrated in FIGS. 1 and 2, with the exception that membrane 34 replaced by a different membrane 134 as regards the closure element for the controlled valve 132 co-operating with the circular edge 79 of the outlet orifice 24 of the circulation chamber 18. The electronic control circuit 70 is replaced by an electronic control circuit 170 functions of which will be detailed below, and the valve 67 is replaced by distributor means 167 which will also be detailed below, for feeding the duct 66 with fluid under pressure, for example air under pressure, or permitting the evacuation of this fluid from the chamber 40 through the duct 66 and the vent 68, in a manner controlled by the electronic circuit 170.

Figure 3:
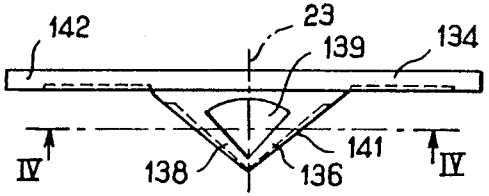
FIG. 3 is a side view of a membrane can be substituted for the membrane of the first embodiment of a filling head according to the invention, a second embodiment of this filling head permitting partial closure of the outlet orifice for filling liquid.
Figure 4:
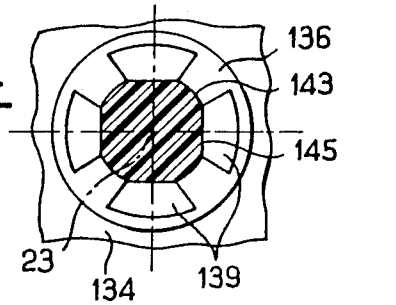
FIG. 4 is a bottom plan view of the projection of this membrane, cut along line IV—IV in FIG. 3.
Figure 5:
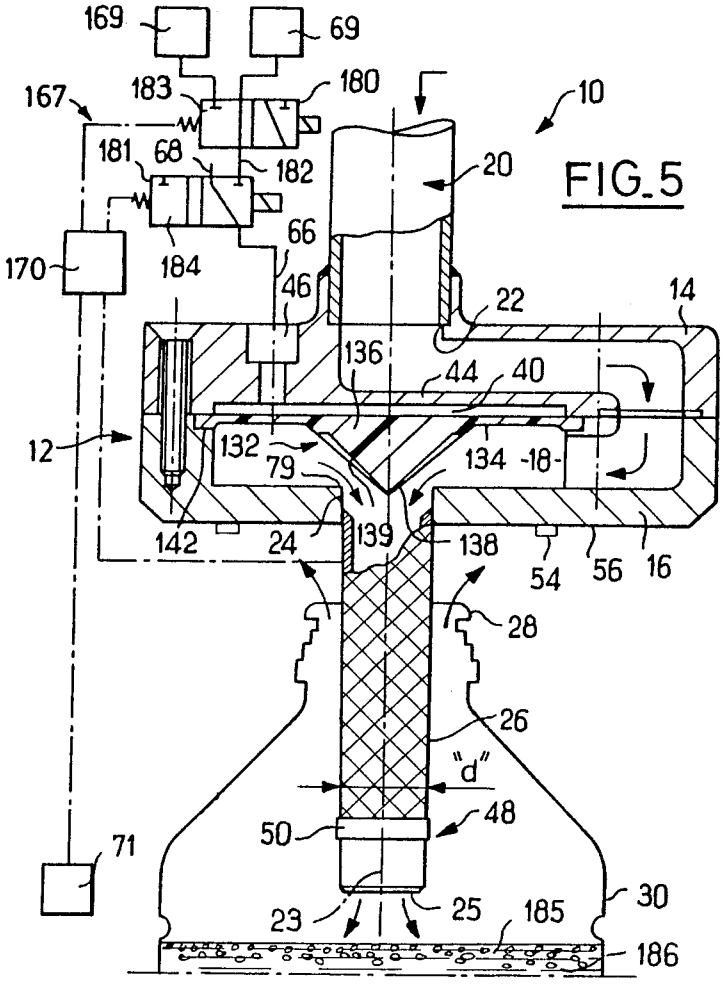
FIG. 5 shows, in a view similar to that of FIG. 1, a second embodiment of the filling head according to the invention when the membrane has its open conformation.

Like membrane 34, the membrane 134 is flexible and elastically deformable, and is made for example of synthetic or natural rubber, or any other elastically compressible material like membrane 34, it has in its free state a conformation for opening of the orifice 24, illustrated in FIGS. 3 to 5, and in which it has the general shape of a flat, horizontal, disc, captive in a rigid and fluid-tight manner, by a circular edge 142, between the two shells 14 and 16 of the body 12 for delimiting inside this the control chamber 40. Like the membrane 34, the membrane 134 presents downwardly, coaxially with the discharge tube 26 a projection 136 delimited by a conical exterior surface 138, and a body of revolution about the axis 23 of the tube 26, as is the entire membrane 134. While the conical surface 38 of the projection 36 of the membrane 34 is smooth, for making in its closure conformation continuous contact with the edge 79 of the outlet orifice 24 in order to fluid-tightly close this latter, the surface 138 of the projection 136 has at least one flat 139, forming to a notch or hollow in this surface 138. Preferably, as illustrated, several flats 139 are thus provided, preferably identical and regularly spaced about the axis 23. More precisely, in the illustrated example, four identical flats 139, regularly spaced about the axis 23 and mutually converging downwards, are provided, but other arrangements can be adopted without departing from the scope of the invention.

Figure 7:
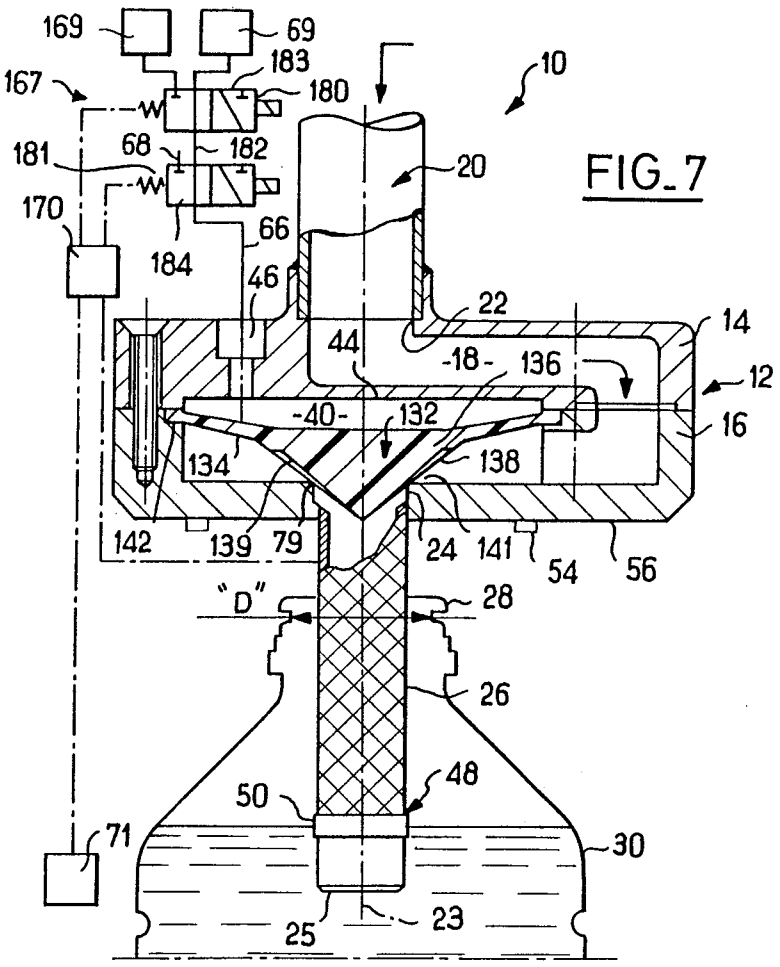
FIG. 7 shows, in a view similar to that of FIG. 5, this same filling head when the membrane has its conformation closing the outlet orifice, at the end of filling.
Figure 6:
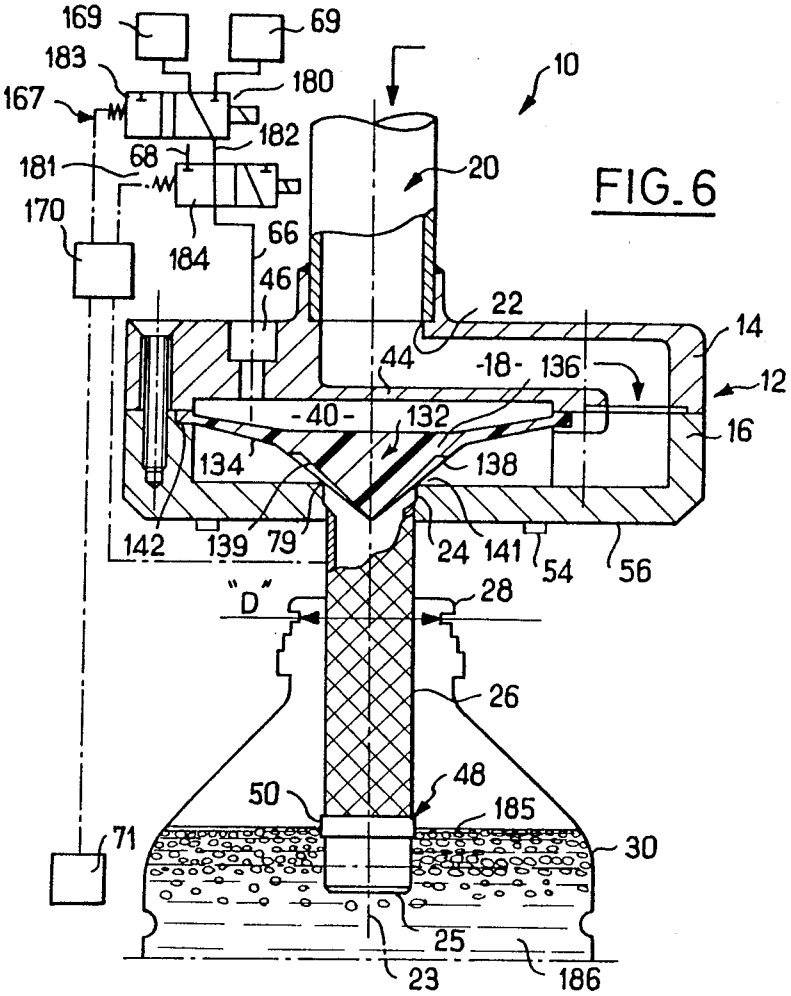
FIG. 6 shows, in a view similar to that of FIG. 5, this same filling head when the membrane has its intermediary conformation of partial closure of the outlet orifice.

When the projection 136 of the membrane 134, in its open conformation illustrated in FIGS. 3 to 5, is viewed in cross section on a horizontal plane, in a zone 141 intended to co-operate with the edge 79 of the outlet orifice 24 when the membrane has its respective intermediate and closure conformations illustrated in FIGS. 6 and 7, the projection 136 thus presents a shape different from the circular shape of the edge 79 of the outlet orifice 24, as FIG. 4 shows. In practice, in the example illustrated particularly in FIGS. 3 and 4, the zone 141 of the projection 136 has in such a section an alternating contour 145, in a manner regularly spaced about the axis 23, four arcs of a circle 143 centered on the axis 23 and corresponding to the conical surface 138, and four straight segments corresponding to the flats 139.

Thus, further to its open conformation illustrated in FIGS. 3 to 5, and which it tends to occupy naturally as a result of its elasticity or under the action of an auxiliary spring, the membrane 134 can also have one hand the conformation illustrated in FIG. 6, in which it is in abutment without substantial compression of the projection 136, at the arcs of the circle 143, on the circular edge 79 of the outlet orifice 24, whilst leaving free between the flats 139 and this circular edge 79 a passage for the filling liquid. It may also have the conformation illustrated in FIG. 7 in which, by compression of the projection 136, continuous contact is established between the edge 79 of the outlet orifice 24 and the surface 138, deformed in the zone 141 so far as to present a cross-section of circular shape identical to that of the edge 79 as shown in FIG. 7. This FIG. 7 conformation results in total closure of the outlet orifice 24, while the intermediate conformation illustrated in FIG. 6 results in partial closure, permitting a passage for filling liquid from the chamber 18 through the orifice 24 and through the tube 26, with a flow much smaller than the flow permitted when the membrane occupies the open position illustrated in FIG. 5.

To move the membrane 134 between these three conformations, as a function of the signals emitted respectively by the means 71 for detection of a bottle 30 in filling position and by the means 48 for detection of the level of filling, the distributor means 167, controlled by the electronic control circuit 170 receiving the signals from the detection means 71 and 48, are able to put the control chamber 40 in communication either with the source 69 of fluid, under pressure, delivering this fluid such as air, to a predetermined pressure P1 for placing the membrane 134 in its closure conformation illustrated in FIG. 7, or with a second source 169 of fluid under pressure, able to deliver a fluid under pressure, such as air, at a predetermined pressure P2 lower than P1 but greater than the pressure of the filling liquid in the chamber 18, for example at atmospheric pressure, for positioning the membrane 134 in its intermediate conformation for partial closure of the outlet orifice 24, illustrated at FIG. 6, or in communication with the vent 68 open to atmosphere.

Various forms of the distributor means 167 and the sources of fluid under pressure 69 and 71 can be selected for this purpose by those skilled in the art, and only the conception actually preferred will be described, requiring two totally distinct sources 69 and 169 of fluid under pressure and two distributors 180 and 181, electrically controlled by the electronic circuit 170, arranged in series in a manner which will now be described with reference to FIGS. 5 to 7.

The distributor 180 has two inputs, connected respectively to the source 69 and to the source 169, and an outlet connected to a duct 182. Similarly, the distributor 181 has two inputs, connected respectively to the duct 182 and to the vent 68, and an outlet connected to the duct 66.

Each of the distributors 180 and 181 further comprises a respective slide 183, 184, which can occupy either a rest position, illustrated in FIG. 7 for the two slides, in FIG. 5 for the slide 183 and in FIG. 6 for the slide 184, or an excitation position illustrated in FIG. 5 as regards the slide 184 and in FIG. 6 as regards the slide 183.

In its rest position, the slide 183 closes in a fluid-tight manner the input to the distributor 180 corresponding to the source 169, but establishes a connection between the source 69 and the duct 182. In the excitation position, the slide 183 closes in a fluid-tight manner the input to the distributor 180 corresponding to the source 69, and places the source 169 in communication with the duct 182.

In its rest position, the slide 184 closes the vent 68 and establishes communication between the duct 162 and the duct 66. In its excitation position, this slide 184 closes in a fluid-tight manner the duct 182 but establishes communication between the vent 68 and the duct 66.

A presently preferred cycle for control of the distributors 180 and 181, by the electronic circuit 170, as a function of the signals emitted by the detection means 71 and 48 is the following.

In the absence of a bottle 30 in the filling position, signalled by the detection means 71, the slides 183 and 184 of the two distributors 180 and 181 occupy their rest position so that the control chamber 40 is in communication with the source 69 of fluid at pressure P1, the value of which is so selected that it causes not only a deformation of the membrane 134 to place its projection 136 in contact with the edge 79 of the outlet orifice 24 of the chamber 18, but further overcomes the resistance of the projection 136 to elastic compression in its zone 141, so that there is established between the projection 136 and the edge 79 a continuous contact for fluid-tight closure between the chamber 18 and the tube 26, as shown in FIG. 7.

Then during operation of the machine, the means 71 detect the presence of an empty bottle 30 in the filling position, defined in the same manner as with reference to the first embodiment of the invention illustrated in FIGS. 1 and 2, the means 48 detecting the absence of filling liquid at their level, the slide 184 of the distributor 181 is driven to its excitation position while the slide 183 of the distributor 180 remains in its rest position, as shown in FIG. 5 shows. The sources 69 and 169 are then respectively isolated by the slide 184 and by the slide 183, and the control chamber 40 is connected to the vent 68 by the slide 184, so that the membrane 134 occupies, as a result of its elasticity, its position for total opening of the outlet orifice 24 of the chamber 18, the projection 136 being totally separated from the edge 79 of this orifice 24 as shown in FIG. 5. The filling liquid can then freely discharge inside the bottle 30, at a flow rate which is preferably sufficient to cause the appearance of froth the surface of the filling liquid 186 in the bottle 30.

When this froth 185 reaches the detection means 48, more precisely the probe 50 in the case of the embodiment illustrated, these means 48 emit a signal which causes, through the intermediary of the electronic control circuit 170, the return of the slide 184 of the distributor 181 to its rest position, as well as the passage of the slide 183 of the distributor 180 to its excitation position. As a result the source 69 is isolated by the slide 183 of the distributor 180, while a connection is established between the control chamber 40 and the source 169 which delivers to this chamber 40 control fluid at the pressure P2, lower than the pressure P1 initially established in this chamber 40, on its connection with the source 69. The pressure P1 is so determined so that its presence in the chamber 40 deforms the membrane 134 sufficiently to establish a contact of the projection 136, via the arcs of the circle 143 in the zone 141, with the edge 79 of the outlet orifice 24, without at all substantially compressing the projection 136. Thus shown in FIG. 6, the membrane 134 has its intermediate conformation between the open conformation illustrated in FIG. 5 and the closure conformation illustrated in FIG. 7, and continues to allows discharge of the filling liquid from the chamber 18 through the tube 26 to the bottle 30, although at a flow rate considerably less than the flow rate established when the membrane occupies the open conformation illustrated in FIG. 5. In particular, this flow rate is such that it no longer causes the appearance of froth at the surface of the liquid 186 in the bottle, and allows dissipation of the froth 185 which appeared during the discharge at the comparatively rapid flow rate.

In a variant, when the froth 185 reaches the probe 50 at the end of the discharge at a rapid flow rate, the two slides 183 and 184 can be returned to the rest position for bringing the membrane 134 to its conformation for total closure of the outlet orifice 24, illustrated in FIG. 7, for a predetermined time necessary for the froth 185 to dissipate. After this predetermined time, due to delay means preferably adjustable and integrated in the electronic control circuit 170, the slide 183 of the distributor 180 is driven to the excited position illustrated in FIG. 6, the slide 184 of the distributor 181 being itself in the rest position, which drives the membrane to its intermediate conformation for partial closure of the orifice 24, illustrated in FIG. 6, for permitting discharge at the said low flow rate.

In either case, this discharge at low flow rate is rendered possible because the collapse of the froth 185 in the bottle returns the filling liquid to a level lower than that of the probe 50, as has been shown by the chain-dotted horizontal line in FIG. 6. When, subsequently, the level of the liquid again reaches the probe 50, in the course of this stage of filling at lower flow rate, this level corresponds exclusively to that of filling liquid in the bottle.

When the probe 50 is thus reached, it sends to the electronic control circuit 170 a signal for closure which causes a new movement of the slide 183 of the distributor 180 to the rest position, while the slide 184 of the distributor 181 remains in the rest position, which leads the membrane 134 to its conformation of total closure of the outlet orifice 24, shown in FIG. 7.

The full bottle is now removed and replaced by an empty bottle, and an identical cycle to that which has been described can be repeated.

Those skilled in the art will easily understand that the shape of the membrane illustrated in FIGS. 3 to 7 constitutes only one example of the shape which the membrane can take with respect to the circular edge 79 of the outlet orifice 24, either a totally open conformation or a totally closed conformation, or an intermediate conformation for partial closure, corresponding preferably to localized, discontinuous, mutual contact between a projecting zone of the membrane and the circular edge 79 of the outlet orifice 24.

Figure 8:
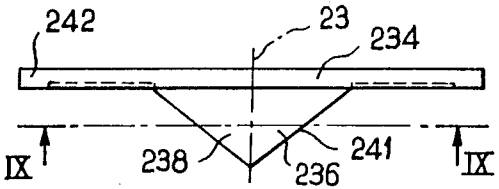
FIG. 8 shows, in a view similar to that of FIG. 3, another example of a membrane which can occupy an intermediary position of partial closure of the outlet orifice.
Figure 9:
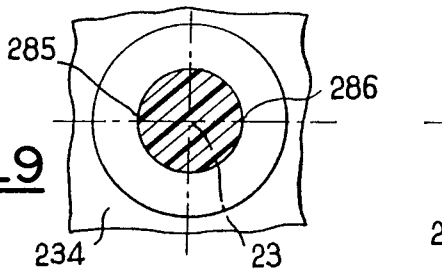
FIG. 9 is a bottom plan view of the projection of this membrane from below, in section along line IX—IX in FIG. 8.

For example, FIGS. 8 and 9 show another shape of the membrane for such an intermediate conformation of partial closure of the outlet orifice 24, in association with a circular shape of the edge 79 of this orifice.

Like membrane 134, the membrane 234 illustrated in FIGS. 8 and 9 has the general shape of a flat disc, in an open conformation which the membrane 234 tends naturally to occupy, with a circular edge 242 being captured in the same manner as the edge 142, between the two shells 14 and 16 of the body 12 of the filling head. Like membrane 134, the membrane 234 has downward projection 236 centered on the axis 23 of the discharge tube 26, and this projection 236 can be elastically compressed. Like the projection 136, the projection 236 has a downward external surface 238 which, however, is smooth in contra-distinction to the surface 138 and which, in horizontal cross-section particularly in the zone 241 intended to cooperate with the circular edge 79 of the outlet orifice 24 for closure thereof, has an oval shape, for example elliptical as shown in FIG. 9.

Thus, further to its open conformation in which the surface 238 of the projection 236 is totally withdrawn upwardly from the circular edge 79 of the orifice 24, the membrane 234 can occupy a position of total closure of this orifice 24, in which the projection 236 is applied by its surface 238, in the zone 241, against the circular edge 79 of the outlet orifice 24 with a force sufficient for causing its elastic compression and a continuous contact between the surface 238 and the edge 79, and an intermediate position in which the surface 238 of the projection 236 comes into contact with the circular edge 79 of the outlet orifice 24 with a force insufficient for causing a substantial compression, so that this contact is established only at two points 285 and 286 of a plane including the axis 23 and the major axis of each of the ellipses, constituting the different sections of the surface 238 in different horizontal planes.

It will be easily understood that the conformation for total opening, the intermediate conformation for partial closure and the conformation for total closure are obtained, under the case of the membrane 234, in the same conditions as in the case of the membrane 134.

Naturally, other membrane shapes will be equally satisfactory, together with a circular shape of edge 79 of the outlet orifice 24, when it is desired that the membrane occupy an intermediate position for partial closure of this orifice.

One can also choose to work for this effect on the shape of the edge, using a membrane having a projection of which the external surface, intended to co-operate with this edge, has itself in any horizontal plane, and particularly in its zone intended to co-operate with this edge, a circular shape.

Figure 10:
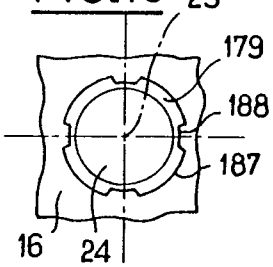
FIGS. 10 and 11 show in bottom plan view possible, shapes of the edge of the outlet orifice, complementing a projection of the membrane with a conical external surface, for permitting also the positioning of the latter in an intermediary conformation of partial closure of the outlet orifice.
Figure 11:
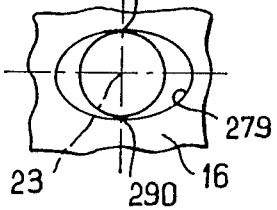

Further, FIGS. 10 and 11 illustrate two specific shapes of the edge of the outlet orifice 24 adapted to co-operate with a membrane with a smooth, conical projection, of the type described with reference to FIGS. 1 and 2.

In the case of the embodiment illustrated in FIG. 10, the outlet orifice 24 has a horizontal edge 179, formed of a regular alternation of arcs of circles 187 and 188 of different radii, respectively larger and smaller, with reference to the axis 23 of the discharge tube 26. The arcs of the circle 188 thus define notches, projecting towards the axis 23, with respect to two arcs of the circle 187, so that, if the reference numerals of FIGS. 1 and 2 are used, membrane 34 can have, under the conditions defined in relation to FIGS. 5, 6 and 7, respectively:

- an open conformation, in which the external conical surface 38 of the projection 36 is totally removed from the edge 179 of the outlet orifice 24, so as to permit the passage of filling liquid at a maximum flow rate,
- an intermediate conformation for partial closure of the orifice 24, in which the surface 38 of the projection 36 of the membrane 34 is applied practically without deformation onto the arcs of the circle 188 of smaller radius, while remaining withdrawn from the arcs of the circle 187 of greater radius so as to permit the passage of filling liquid at a comparatively reduced flow rate, and
- a position of total closure of the outlet orifice 24, supposing an elastic compression of the projection 36 at least in its zones in contact with the arcs of the circle 188 of smaller radius, so as to establish continuous contact between the surface 38 thus formed and the entire edge 179 of the outlet orifice 24 of the filling chamber 18.

FIG. 11 shows another example, in accordance with which the outlet orifice 24 of the chamber 18 has a horizontal edge 279 of oval shape, for example elliptical, symmetrical with respect to the axis 23 of the discharge tube 26. In this case, in addition to the conformations for opening and total closure corresponding respectively to a total disengagement from the edge 279 by the conical surface 38 of the projection 36 of the membrane 34 and to a pressing of this surface 38 against the edge 279 for establishing continuous contact therewith, the membrane 34 can have an intermediate conformation in which the frusto-conical surface 38 of the projection 36 is in point abutment, without substantial compression of the projection 36, with the edge 279 at two points 289 and 290 situated on the minor axis of the ellipse.

In this case, also, other shapes are possible. The edge 79 may be made of an elastically compressible material, replacing or complementing elastic compressibility of the projection of the membrane, whatever the respective shapes chosen for the projection of this membrane and for the edge of the outlet orifice from the circulation chamber for the filling liquid.

Further, as mentioned above with reference to FIGS. 1 and 2, in which it is not provided that the membrane has an intermediate conformation for partial closure of the outlet orifice of the circulation chamber for filling liquid, one can provide, in one of the several embodiments of the invention envisaging the possibility of such an intermediate conformation, that the membrane tends to have naturally, from its own elasticity or under the action of an auxiliary spring (not shown), not its conformation for total opening but its conformation for total closure or its conformation for partial closure.

When the membrane tends to occupy naturally its total closure position, the two sources 69 and 169 of fluid under pressure are replaced by vacuum sources, evacuated to different values, and the cycle of functioning of the distributor means 167 is modified in the following manner, assuming by way of example that the membrane is of the type illustrated at 134 in FIGS. 5 to 7:

To permit the membrane 134 to occupy its position of total closure of the outlet orifice 24, illustrated in FIG. 7, the chamber 40 is put in contact with the vent 68 and the two sources of vacuum are isolated, the slides 183 and 184 of the distributor 180 and 181 occupying their positions illustrated in FIG. 5, To place the membrane 134 in its conformation for partial closure of the orifice 24, illustrated in FIG. 6, the chamber 40 is evacuated by connecting it to the vacuum source establishing the higher absolute pressure, while placing the slides 183 and 184 in their positions illustrated in FIG. 6 if this source of vacuum replaces the source of pressure 169, To place the membrane 134 in its position for total opening, illustrated in FIG. 5, the chamber 40 is evacuated by means of the vacuum source corresponding to the lower absolute pressure, i.e., the vacuum source replacing the source of pressure 69 in the illustrated example, placing the slides 183 and 184 of the distributors 180 and 181 in the position illustrated in FIG. 7.

When the membrane, supposedly of the type illustrated at 134, naturally occupies its intermediate conformation for partial closure, illustrated in FIG. 6, the source of pressure 69 is retained and the source of pressure 169 is replaced by vacuum source, in comparison with the embodiment illustrated in FIGS. 5 to 7, and the different conformations of the membrane are obtained in the following manner:

- the conformation for partial closure is obtained by opening the chamber 40 to atmosphere, by placing it in communication with the vent 68, due to positioning of the slides 183 and 184 in accordance with FIG. 5,
- the conformation for total closure is obtained under the same conditions as that of FIG. 7 as regards the positioning of the slides 183 and 184, to place the chamber 40 in connection with the source of pressure 69, and
- the conformation for total opening is obtained by evacuating the chamber 40, i.e., by placing the latter in communication with the source of vacuum replacing the source of pressure 169, and placing the slides 183 and 184 of the distributors 180 and 181 in their position illustrated in FIG. 6.

In each of the above-described embodiments of the invention, the precise adjustment of the filling level is obtained by adjustment of the relative height of the head on the machine which it equips, and of the bottle in the filling position, by conventional means which act on the machines in which the filling position is obtained by descent of the filling head towards the bottle, resting on a fixed height support, possibly adjustable, or for machines in which this filling position is reached by lifting of the bottle, resting on a seat, towards the filling head, of the fixed height, possibly adjustable. In fact, in such machines, means are traditionally provided for adjusting the height limits respectively of the head and of the seats during their movement.

The filling heads according to the invention can be used to replace the filling heads of existing machines, whether these machines are machines with fixed heads and movable seats or machines with a fixed bottle support and movable heads.

According to the invention, this new type of filling head permits great simplification of the circuits for cleaning the machine. This will be apparent from FIG. 13, which shows a conventional machine equipped with filling heads of the type illustrated in FIGS. 1 and 2. Those skilled in the art will easily understand that any one of the filling heads according to the invention illustrated totally or partially in FIGS. 3 to 11 can be substituted for this the method of operation of cleaning.

Figure 12:
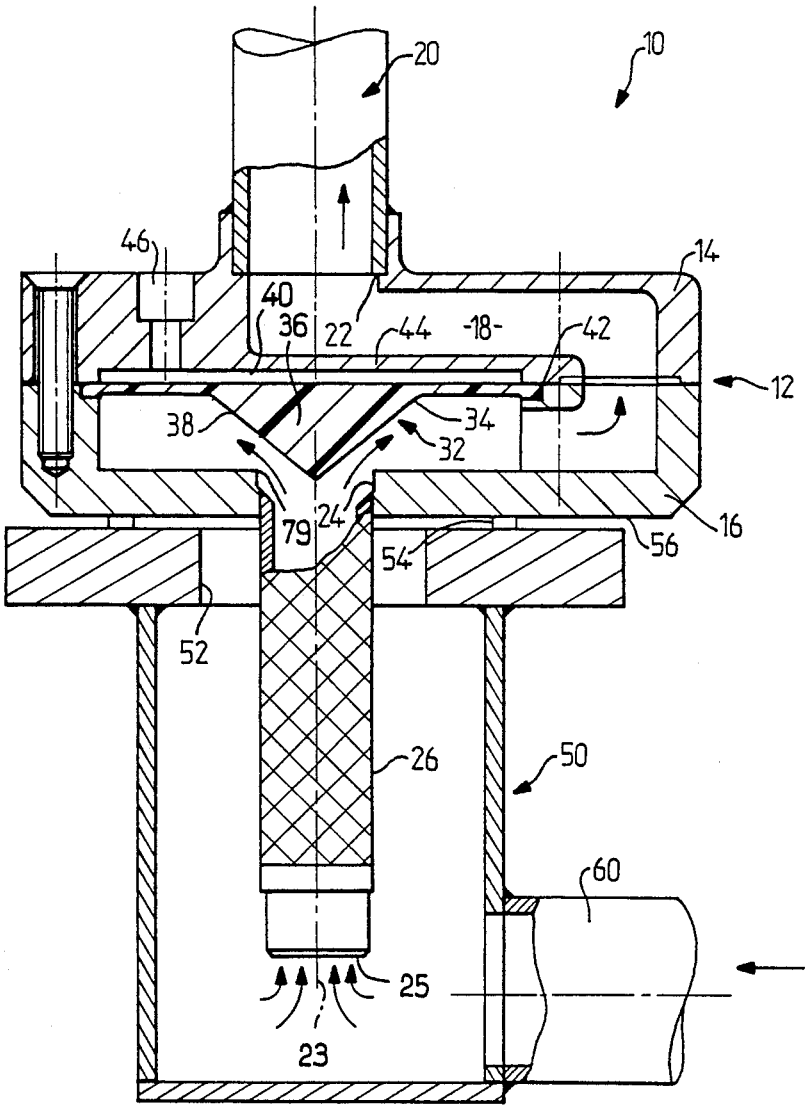
FIG. 12 is a view similar to that of FIG. 1, the head and the membrane being shown in a cleaning position.

In a manner known per se, this machine comprises at its lower part a hollow channel 200, fixed in height and having a circular annular shape centered on the vertical axis 72 about which it is driven in rotation. This channel has upwardly a plurality of upper orifices 52, regularly angularly spaced about the axis 72, and in positions each of which can serve as a support for a bottle in its filling position. In vertical alignment with each orifice 52, the machine carries a filling head 10 according to the invention, on the vertical axis, which head is movable vertically for revolving, during rotation about the axis 72 and independently of the other heads 10, between a first position in which its discharge tube 26 enters into a bottle 30 resting on the channel 200 as to occupy a predetermined level with, respect to the matter and determining the filling level, and a second position in which the discharge tube 26 is disengaged upwardly to permit horizontal departure of the full bottle and the horizontal arrival of the next empty bottle, and on the other hand to provide vertical descent, together with all the other heads 10, into a washing position illustrated in FIGS. 12 and 13, in the absence of any bottle on the channel 200. In this position, the discharge tube 26 of each head 10 enters into the channel 200 via the corresponding orifice 52, about which fluid-tightness is established, between the head 10 and the channel 200, by an annular seal 54 arranged under a lower face 56 of each head, coaxially with its discharge tube 26.

The feed tube 20 for each head enters vertically, with the possibility of relative vertical, sealed sliding, into the filling vat 58 which has a circular, annular shape about the axis 72 and is driven in rotation about this axis together with the heads 10 and the channel 200. Via a turning distributor 73 arranged on the axis 72, the filling vat 58 is connected to a fixed duct 74, connecting with a reservoir (not shown) of filling liquid, possibly via a pump (not shown).

In a manner characteristic of the present invention, the machine comprises no circuit for evacuation of overfilling of filling liquid into the bottle and of return of air and, in particular, the filling vat 58 can be integrally full of filling liquid, instead of being partially full of air as in the case of conventional machines, during the filling bottles. Further, the cleaning circuit 62 can be considerably simplified.

The circuit 62 is essentially fixed, with the exception of a connection 60 provided on the channel 200 and opening into a lower part thereof. When the machine is stopped for cleaning, the connection 60, which is closed during the filling of bottles, permits connection of the inside of the channel 200 with a fixed delivery duct 76 from a fixed pump 64 drawing cleaning liquid from a fixed tank 77, into which opens a fixed return duct 78 for the cleaning liquid. This return duct 78 branches from the duct 74 at a distributor valve 75 which, when the machine is filling bottles, opens the connection between the duct 74 and the reservoir of filling liquid (not shown) via the optional filling pump (not shown) isolating the duct 78 with respect to the duct 74 and which, when the machine is to be cleaned, connects the duct 78 to the duct 74 isolating this latter with respect to the reservoir of filling liquid and the optional filling pump.

The single cleaning circuit 62 is limited to the mentioned elements 60, 64, 75, 76, 77, 78.

During cleaning, the pump 64 draws cleaning liquid into the tank 77 and causes it to circulate under pressure successively in the duct 76, the bottle-carrying means, the channel 200 including, each discharge tube 26, each circulation chamber 18 possibly causing transformation of the corresponding membrane 34 to its position for opening the corresponding orifice 24, each tube 20, the filling vat 58, the turning distributor 73, the duct 74 as far as the valve 75 and the return duct 78. The discharge tubes 26, the circulation chambers 18, the tubes 20 the filling vat 20, the turning distributor 73 and the duct 74 are then swept by the cleaning liquid, in reverse flow direction to the one in which they are swept by the filling liquid when the machine operates for filling bottles, which integrally ensures cleaning under optimal conditions. It will be understood that, during cleaning, each of the flexible deformable membranes is in its open conformation.

The same advantages are present in the case of a machine with movable seats, replacing the channel 200 as a bottle support, and giving each seat a hollow structure and providing a removable connection permitting connection of each seat, when rotation is stopped, to the delivery duct of a pump for circulation of cleaning liquid. The cleaning circuit is otherwise identical to the previously described circuit 62.

Particularly in the case of equipment by means of filling heads according to the present invention, of a pre-existing machine not having a hollow bottle support, cleaning can also be carried out by means of false bottles positioned on the bottle supports and provided with means for connection to the duct 76 from the delivery of the pump 64 of a circuit 62 otherwise identical to that which has been described.

We claim:

1. A filling head for a machine for automatic filling of bottles having necks, said filling head comprising a body, a circulation chamber delimited by said body, a feed orifice through which a filling liquid entering said chamber and an outlet orifice from which said filling liquid leaves said chamber, said outlet orifice being situated at a lower part of said circulation chamber, a discharge tube extending outlet orifice and adapted to enter inside a neck of a bottle during filling, and a control valve having a closure element means for detecting a filling level, said closure element means being arranged in a zone of said discharge tube situated inside said bottle during filling, said detecting means emitting control signals, said control valve receiving said control signals and selectively opening and closing one of said feed and outlet orifices in response to said control signals, wherein said closure element of said valve is a flexible membrane, a fluid-tight control chamber delimited by said membrane being arranged inside said circulation chamber and comprising opposite said outlet orifice a projection portion having an external surface adapted to co-operate with an edge of said outlet orifice for closure of said outlet orifice, said membrane being deformable between (a) an open conformation of said outlet orifice in which said external surface is separated from said edge of said outlet orifice, (b) a closure conformation of said outlet orifice in which said external surface co-operates with said edge of said outlet orifice for closing said outlet orifice in a fluid-tight manner, and (c) an intermediate conformation for partial closure of said outlet orifice, means for fluidic control being connected to said control chamber for deformation of said membrane from one to another of said conformations an inversely as a function of said control signals.

2. A filling head according to claim 1, wherein said projection portion is elastically compressible and has an external surface comprising a zone which cooperates with an edge of said outlet orifice when said membrane has said closure conformation, said edge and said zone having different shapes when said membrane has said open confirmation, whereby, when said membrane has said intermediate conformation, said external surface and said edge are in mutual localized, discontinuous contact and, when said membrane has said closure confirmation, said projection is elastically compressed to establish continuous, fluid-tight contact with said edge.

3. A filling head according to claim 2, wherein said zone has a circular shape when said membrane has said open conformation, and said edge has a shape other than a circular shape.

4. A filling head according to claim 3, wherein said edge is oval.

5. A filling head according to claim 3, wherein said edge has a generally circular locally notched shape.

6. A filling head according to claim 5, wherein said edge has a plurality of regularly spaced notches.

7. A filling head according to claim 3, wherein said projection portion is conical.

8. A filling head according to claim 2, wherein said edge has a circular shape and said zone has a shape other than a circular shape when said membrane has said open conformation.

9. A filling head according to claim 8, wherein said zone is oval.

10. A filling head according to claim 8, wherein said zone has a generally circular locally notched shape.

11. A filling head according to claim 10, wherein said zone has a plurality of regularly spaced notches.

12. A filling head according to claim 10, wherein said external surface of said projection portion has a generally conical shape.

13. A filling head according to claim 2, wherein said membrane tends elastically to have said open conformation and said fluidic control means for deformation of said membrane comprises a source of fluid under pressure, distributor means connecting said control chamber to said source of fluid under pressure, and means for control of said distributor means as a function of said control signals, in order to selectively admit said fluid into said control chamber at a first predetermined pressure for transformation of said membrane to said intermediate conformation, and at a second predetermined pressure greater than said first predetermined pressure for transformation of said membrane to said closure confirmation, and to open said control chamber to atmosphere, for transformation of said membrane to said open conformation.

14. A filling head according to claim 2, wherein said membrane tends elastically to have said closure conformation and said fluidic control means for deformation of said membrane comprises vacuum means, distributor means connecting said control chamber to said vacuum means, distributor means connecting said control chamber to said vacuum means, and means for control of said distributor means as a function of said control signals, in order to selectively evacuate said control chamber, at a first predetermined evacuation pressure for transformation of said membrane to said intermediate conformation, at a second predetermined evacuation pressure with a lower value of absolute pressure from that of said first predetermined evacuation pressure for transformation of said membrane to said open confirmation, and to open said control chamber to atmosphere for transformation of said membrane to said closed conformation.

15. A filling head according to claim 2, wherein said membrane tends elastically to have said intermediate conformation and said means for fluidic control of deformation of said membrane comprises both a source of fluid under pressure and evacuation means, distributor means connecting said control chamber to said source of fluid under pressure and to said evacuation means, and means for control of said distributor means as a function of said control signals, in a manner to selectively open said control chamber to atmosphere for transformation of said membrane to said intermediate conformation, to evacuate said control chamber for transformation of said membrane to said open conformation, and to admit said fluid into said control chamber for transformation of said membrane to said closure conformation.

16. A filling head according to claim 13 or 15, wherein said fluid under pressure is air.

17. A filling head according to claim 1, wherein said body of said filling head comprises upper and lower shells, and said membrane is in the form of a disc having a circular edge which is captive in a fluid-tight manner between said upper and lower shells, said upper shell having an internal portion which delimits said control chamber.

18. A filling head according to claim 1, wherein said discharge tube has an external diameter smaller than an internal diameter of said neck of said bottle to be filled in order to permit free escape of air from said bottle during its filling.

19. An automatic filling machine for filling bottles having necks, equipped with at least one filling head comprising a body, a circulation chamber delimited by said body, a feed orifice through which a filling liquid entering said chamber and an outlet orifice from which said filling liquid leaves said chamber, said outlet orifice being situated at a lower part of said circulation chamber, a discharge tube extending said outlet orifice and adapted to enter inside a neck of a bottle during filling, and a control valve having a closure element means for detecting a filling level, said closure element means being arranged in a zone of said discharge tube situated inside said bottle during filling, said detecting means emitting control signals, said control valve receiving said control signals and selectively opening and closing one of said feed and outlet orifices in response to said control signals, wherein said closure element of said valve is a flexible membrane, a fluid-tight control chamber delimited by said membrane being arranged inside said circulation chamber and comprising opposite and outlet orifice a projection portion having an external surface adapted to co-operate with an edge of said outlet orifice for closure of said outlet orifice, said membrane being deformable between (a) an open conformation of said outlet orifice in which said external surface is separated from said edge of said outlet orifice, (b) a closure conformation of said outlet orifice in which said external surface co-operates with said edge of said outlet orifice for closing said outlet orifice in a fluid-tight manner, and (c) an intermediate conformation for partial closure of said outlet orifice, means for fluidic control being connected to said control chamber for deformation of said membrane from one to another of said conformations and inversely as a function of said control signals.

20. A filling machine according to claim 19, comprising a lower part provided with hollow bottle-carrying means on which a plurality of said heads are arranged in a fluid-tight manner by a relative approach movement for cleaning of said machine, said machine having a single cleaning circuit comprising a pump which circulates a cleaning liquid under pressure inside said bottle-carrying means and inside each of said at least one filling heads, in reverse flow to said filling liquid, each of said flexible deformable membranes being in its open conformation during cleaning.

* * * * *